US009303582B2

(12) United States Patent
Richter et al.

(10) Patent No.: US 9,303,582 B2
(45) Date of Patent: Apr. 5, 2016

(54) METHOD FOR OPERATING A FUEL DELIVERY DEVICE

(75) Inventors: Uwe Richter, Markgroeningen (DE); Joerg Kuempel, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 283 days.

(21) Appl. No.: 14/128,602

(22) PCT Filed: May 2, 2012

(86) PCT No.: PCT/EP2012/057988

§ 371 (c)(1),
(2), (4) Date: Mar. 28, 2014

(87) PCT Pub. No.: WO2012/175248

PCT Pub. Date: Dec. 27, 2012

(65) Prior Publication Data

US 2014/0224222 A1 Aug. 14, 2014

(30) Foreign Application Priority Data

Jun. 22, 2011 (DE) ..... 10 2011 077 987

(51) Int. Cl.

| | |
|---|---|
| ***F02D 41/30*** | (2006.01) |
| ***F02D 41/38*** | (2006.01) |
| ***F02D 41/20*** | (2006.01) |
| ***F02M 59/36*** | (2006.01) |
| *F02M 63/02* | (2006.01) |

(52) U.S. Cl.

CPC ..... *F02D 41/3005* (2013.01); *F02D 41/20* (2013.01); *F02D 41/3845* (2013.01); *F02M 59/368* (2013.01); *F02M 63/0265* (2013.01)

(58) Field of Classification Search

CPC . F02D 41/30; F02D 41/3005; F02D 41/8845; F02D 41/20; F02M 59/368; F02M 63/0265

See application file for complete search history.

(56) References Cited

U.S. PATENT DOCUMENTS 6,830,201 B2 * 12/2004 Seelbach ..... F02M 59/466 239/533.3
7,028,667 B2 * 4/2006 Hori ..... F02D 41/406 123/446

(Continued)

FOREIGN PATENT DOCUMENTS

DE 198 34 120 A1 2/2000
DE 10 2008 054 702 A1 6/2010

(Continued)

OTHER PUBLICATIONS

International Search Report corresponding to PCT Application No. PCT/EP2012/057988, mailed Sep. 21, 2012 (German and English language document) (5 pages).

*Primary Examiner* — Hieu T Vo

(74) *Attorney, Agent, or Firm* — Maginot, Moore & Beck LLP

(57) ABSTRACT

The disclosure relates to a method for operating a fuel delivery device of an internal combustion engine, in which method an electromagnetic actuating device of a volume control valve is switched such as to set a delivery volume, wherein a control of the electromagnetic actuating device for moving an armature of the electromagnetic actuating device from a first position to a second position comprises at least three phases, wherein in a first phase a coil of the electromagnetic actuating device is permanently connected to a voltage, and wherein in a second phase the coil is periodically connected to the voltage with a first frequency and with a first duty factor, and wherein in a third phase the coil is periodically connected to the voltage with a second frequency and with a second duty factor.

7 Claims, 4 Drawing Sheets

(56) References Cited

U.S. PATENT DOCUMENTS

2011/0094476 A1 4/2011 Ibrahim et al.
2014/0311456 A1* 10/2014 Richter ..... F02D 41/3845
123/476

FOREIGN PATENT DOCUMENTS

EP 1 042 607 B1 10/2004
EP 1 741 912 A2 1/2007

* cited by examiner

METHOD FOR OPERATING A FUEL DELIVERY DEVICE

This application is a 35 U.S.C. §371 National Stage Application of PCT/EP2012/057988, filed on May 2, 2012, which claims the benefit of priority to Serial No. DE 10 2011 077 987.6, filed on Jun. 22, 2011 in Germany, the disclosures of which are incorporated herein by reference in their entirety.

BACKGROUND

The disclosure relates to a method as described herein and to an actuation circuit, a computer program and an open-loop and/or closed-loop control device as described herein.

Quantity control valves, for example in a fuel delivery device of an internal combustion engine, are known commercially. Quantity control valves generally operate electromagnetically and are frequently a component of a high-pressure pump of the fuel delivery device. The quantity control valve controls the fuel quantity flowing to a high-pressure accumulator from which the fuel is conducted to the injection valves of the internal combustion engine. For example, the quantity control valve has two switched states, between which it is possible to switch by means of electronic actuation.

A patent publication from this specialist field is, for example, EP 1 042 607 B1.

SUMMARY

The problem on which the disclosure is based is solved by a method as described herein and by an actuation circuit, an open-loop and/or closed-loop control device and a computer program. Advantageous developments are described herein. Important features for the disclosure are also to be found in the following description and in the drawings, wherein the features can be important for the disclosure either alone or in different combinations without explicit reference being made once more thereto.

The method according to the disclosure has the advantage that an electromagnetic activation device of a quantity control valve can be actuated particularly easily and cost-effectively by means of a pulse-width-modulated voltage, wherein good switching properties are made possible. There is no need to regulate the current of the output stage by means of switching thresholds. The electrical energy to be applied or the electrical power loss and the achievable speed of the armature movement, possible tolerances of the armature attraction time and the operational noise can be compared with the properties of current-regulated actuation. There is also no need to overdimension the electromagnetic activation device. With respect to conventional actuation processes with pulse-width modulation, the disclosed actuation of the output stage requires less electrical power and involves lower thermal loading.

The disclosure relates to a method for operating a fuel delivery device of an internal combustion engine, in which, in order to set a delivery quantity, an electromagnetic activation device of a quantity control valve which is arranged in an inflow to a delivery space of the fuel delivery device is switched. For this purpose, by means of the actuation energy is fed to the electromagnetic activation device at each switching process in which an armature of the electromagnetic activation device is to be moved in the direction of a stroke stop counter to the force of an armature spring, for example. In this context, the actuation is carried out by means of a pulse-width modulation. For this purpose, for example, a battery voltage ("voltage") is connected repeatedly and at least at certain times periodically to a coil of the electromagnetic activation device. In accordance with the law of induction, this results in certain sections in approximately ramp-shaped time profiles of the current flowing through the coil.

The actuation of the electromagnetic activation device or of the coil takes place in such a way that the armature is moved from a first position—generally from a position of rest—to a second position—generally to a stroke stop. In this context, the actuation according to the disclosure comprises at least three phases. In a first phase, the coil is continuously connected to the voltage for a comparatively short time period. In a subsequent second phase, the coil is periodically connected to the voltage with a first frequency and with a first pulse duty factor. In a subsequent third phase, the coil is again periodically connected to the voltage with a second frequency and with a second pulse duty factor. In this context, the first and second pulse duty factors are generally different from one another. The second pulse duty factor is preferably set in such a way that a mean electrical power level during the third phase is lower than during the second phase.

One refinement of the disclosure provides that a respective duration of the three phases and/or the first frequency and/or the second frequency and/or the first pulse duty factor and/or the second pulse duty factor are set as a function of the voltage and/or a temperature and/or a line resistance and/or a rotational speed of the internal combustion engine. In this context, the temperature is, for example, a temperature of the coil and the line resistance is a feedline resistance of a cable for connecting the coil to an actuation circuit, which is preferably arranged in an open-loop and/or closed-loop control device of the internal combustion engine. As a result, the actuation of the electromagnetic activation device—that is to say the coil—can be adapted particularly precisely to respective operating conditions. Therefore, it is possible to achieve, on the one hand, rapid and reliable switching of the electromagnetic activation device or of the quantity control valve and. on the other hand, optimized energy consumption.

Furthermore, the disclosure provides that the first and second phases bring about an attraction phase of the armature, and that the third phase brings about a holding phase of the armature. The attraction phase is that phase in which the armature is moved from the rest seat as far as the stroke stop by magnetic force. The holding phase is that phase in which the armature is held in its position against the stroke stop by a, generally lower, magnetic force. In this way, respectively optimized actuation can take place for the attraction phase and the holding phase.

In particular, the method according to the disclosure can advantageously be used to model conventional, so-called "current-regulated" actuation of the electromagnetic activation device and to replace this with a virtual equivalent, allowing considerable expenditure to be avoided. "Current-regulated" actuation generally uses a lower and an upper current threshold in order to control the current flowing through the coil by using a hysteresis. If the lower current threshold is undershot, the coil is connected to the voltage. If the upper current threshold is exceeded, the coil is disconnected from the voltage. As a result, an oscillating time profile of the coil current between the two current thresholds is obtained.

For current-regulated actuation, the energy W which is to be applied during the attraction phase is proportional to an integral of the current I over the attraction time t:

$$W_{current\text{-}regulated} \sim \int_{t\text{-}attraction\text{-}start}^{t\text{-}attraction\text{-}end} I_{current\text{-}regulated}(t)dt$$

For the actuation according to the disclosure, the energy W which is to be applied during the attraction phase is also proportional to an integral of the current I over the attraction time t:

$$W_{3\text{-}phases} \sim \int_{t\text{-}attraction\text{-}start}^{t\text{-}attraction\text{-}end} I_{3\text{-}phases}(t)dt$$

The actuation according to the disclosure is preferably dimensioned here in such a way that an equivalence is established between the quantities of energy W which are to be applied during the attraction phase:

$$W_{3\text{-}phases} \stackrel{!}{=} W_{current\text{-}regulated}$$

This means that a total energy quantity of the disclosed actuation of the coil during the first and second phases is the same, or is to be as far as possible the same, as a total energy quantity of the current-regulated actuation during the attraction phase. This is done by in each case suitably dimensioning the duration of the three phases and/or of the first frequency and/or the second frequency and/or the first pulse duty factor and/or the second pulse duty factor. In addition, in a comparable fashion it is possible to make a total energy quantity of the actuation of the coil during the third phase approximately the same, or as far as possible the same, as a total energy quantity of the current-regulated actuation during the holding phase.

The method according to the disclosure is simplified if the respective duration of the three phases and/or the first frequency and/or the second frequency and/or the first pulse duty factor and/or the second pulse duty factor are determined using at least one characteristic diagram. The characteristic diagram can take into account the abovementioned dependence on the voltage, the coil temperature, the line resistance and/or the rotational speed of the internal combustion engine in a particularly simple and reliable way. The characteristic diagram for a specific series of quantity control valves can optionally be determined once on a test bench and stored, for example, in a data memory of the open-loop and/or closed-loop control device of the internal combustion engine.

Further simplification of the method is achieved when the first frequency is equal to the second frequency. As a result, simplified clock generation for actuating the electromagnetic activation device can be used, wherein the mean electrical power levels, which are different during the second and third phases, are set substantially by means of a respective pulse duty factor.

Furthermore, the disclosure comprises an actuation circuit for actuating the electromagnetic activation device of the quantity control valve, which actuation circuit has means for carrying out actuation by means of at least three phases as described herein. According to the disclosure, the actuation takes place by means of pulse-width modulation of the voltage which generates the actuation energy. The electronic circuit which is necessary for this purpose can be manufactured easily and cost-effectively. The method according to the disclosure can be scaled within wide limits, with the result that it is frequently not necessary to provide different structural embodiments of the actuation circuit.

The method can be carried out particularly easily if it is carried out by means of a computer program on the open-loop and/or closed-loop control device ("control unit") of the internal combustion engine, in particular using the characteristic diagram described above. In one preferred refinement, the control unit is set up by loading the computer program with the features of the independent computer program request from a storage medium. The storage medium is to be understood in this respect as any device which contains the computer program in a stored form.

BRIEF DESCRIPTION OF THE DRAWINGS

Exemplary embodiments of the disclosure will be explained below with reference to the drawings, in which.

DETAIL DESCRIPTION

The same reference symbols are used for functionally equivalent elements and variables in all the figures, even in the case of different embodiments.

Figure 1:
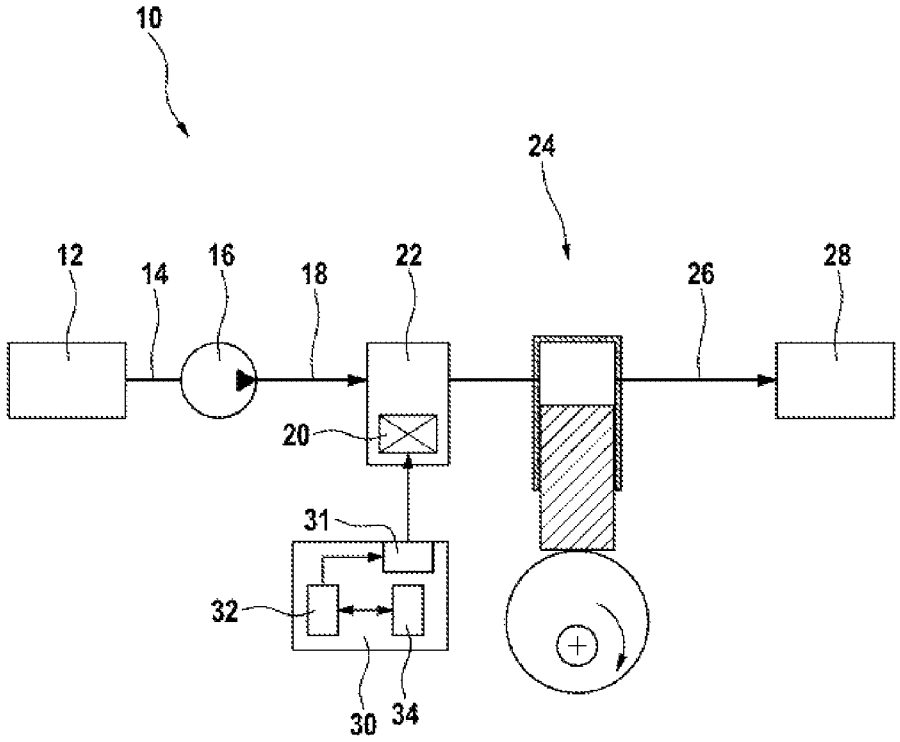
FIG. 1 shows a simplified diagram of a fuel delivery device of an internal combustion engine.

FIG. 1 shows a fuel delivery device 10 of an internal combustion engine in a highly simplified illustration. Fuel is fed from a fuel tank 12 to a high-pressure pump 24 via a suction line 14, by means of a prefeeding pump 16, via a low-pressure line 18 and via a quantity control valve 22 which is activatable by an electromagnetic activation device 20 ("electromagnet"). The high-pressure pump 24 is connected downstream to a high-pressure accumulator 28 ("common rail") via a high-pressure line 26. Other elements such as, for example, valves of the high-pressure pump 24 are not shown in FIG. 1. The electromagnetic activation device 20 is actuated by means of an actuation circuit 31 which is arranged on an open-loop and/or closed-loop control device 30. In addition, the open-loop and/or closed-loop control device 30 has a computer program 32 and a characteristic diagram 34.

Of course, the quantity control valve 22 can also be embodied as one structural unit with the high-pressure pump 24. For example, the quantity control valve 22 can be a forced-opening inlet valve of the high-pressure pump 24.

During the operation of the fuel delivery device 10, the prefeeding pump 16 delivers fuel from the fuel tank 12 into the low-pressure line 18. In the process, the quantity control valve 22 controls the fuel quantity fed to a working space of the high-pressure pump 24 by moving an armature 46 (see FIG. 2) of the electromagnet 20 from a first to a second position, and vice versa. The quantity control valve 22 can therefore be closed and opened.

Figure 2:
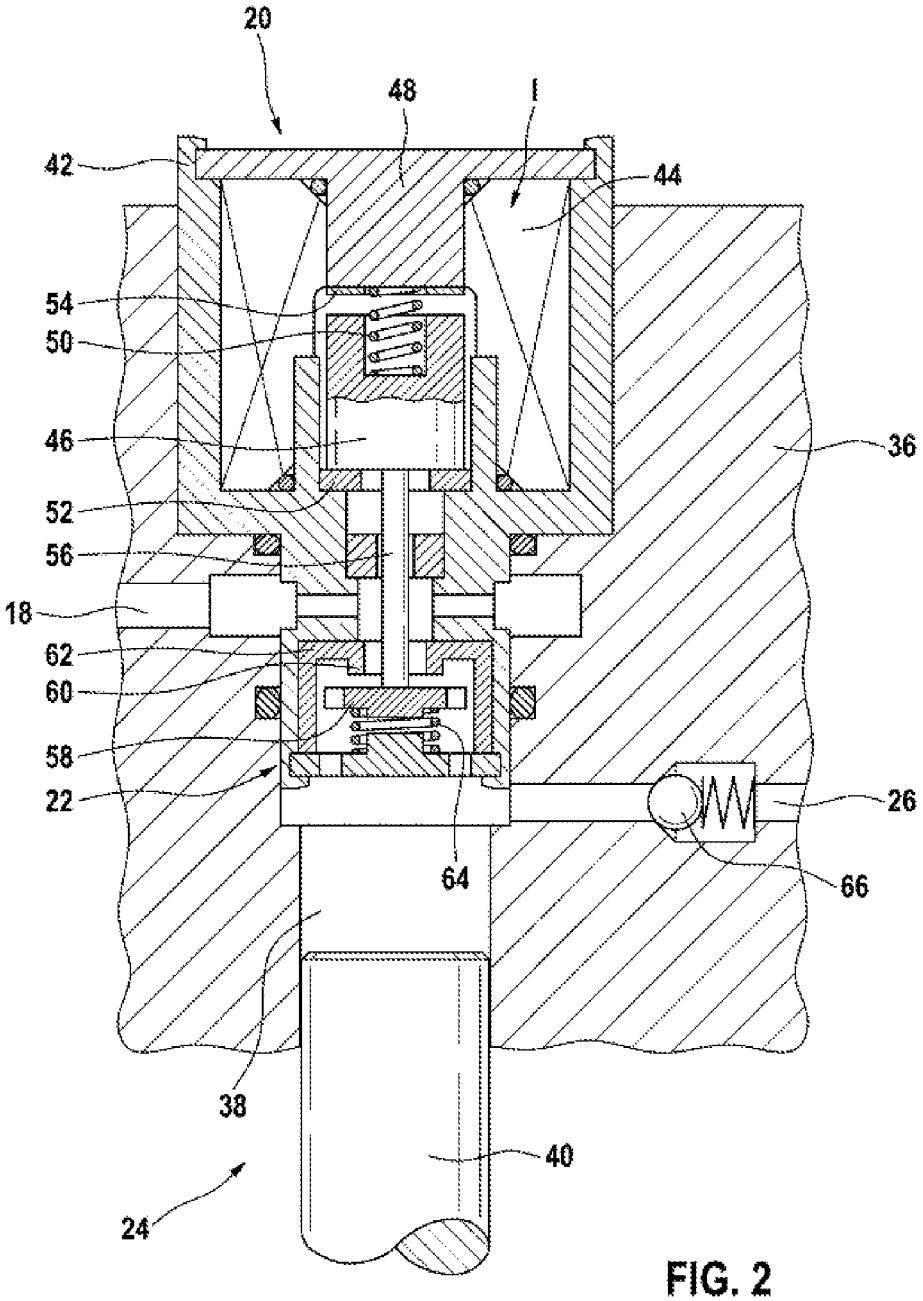
FIG. 2 shows a sectional illustration of a high-pressure pump of the fuel delivery device together with a quantity control valve and an electromagnetic activation device.

FIG. 2 shows a sectional illustration (longitudinal section) of a detail of the high-pressure pump 24 of the fuel delivery device 10 together with the quantity control valve 22 and the electromagnetic activation device 20. The illustrated arrangement comprises a housing 36 in which the electromagnetic activation device 20 is arranged in the upper region in the drawing, the quantity control valve 22 is arranged in the central region, and a delivery space 38 together with a piston 40 of the high-pressure pump 24 is arranged in the lower region.

The electromagnetic activation device 20 is arranged in a valve housing 42 and comprises a coil 44, an armature 46, a pole core 48, an armature spring 50, a rest seat 52 and a stroke stop 54. The rest seat 52 constitutes the first position of the armature 46, and the stroke stop 54 constitutes the second position of the armature 46. The armature 46 acts on a valve body 58 by means of a coupling element 56. An associated sealing seat 60 is arranged above the valve body 58 in the drawing. The sealing seat 60 is part of a pot-shaped housing element 62 which encloses, inter alia, the valve body 58 and a valve spring 64. The sealing seat 60 and the valve body 58 form the inlet valve of the high-pressure pump 24.

The non-energized state of the electromagnetic activation device 20 is illustrated in FIG. 2. Here, the armature 46 is pressed downward in the drawing against the rest seat 52 by means of the armature spring 50. As a result, the valve body 58 is acted on by the coupling element 56 counter to the force of the valve spring 64, as a result of which the inlet valve or the quantity control valve 22 opens. As a result, a fluidic connection is produced between the low-pressure line 18 and the delivery space 38.

In the energized state of the electromagnetic activation device 20, the armature 46 is attracted magnetically by the pole core 48, as a result of which the coupling element 56, connected to the armature 46, is moved upward in the drawing. As a result, given corresponding fluidic pressure conditions, the valve body 58 can be pressed against the sealing seat 60 by the force of the valve spring 64, and thus close the inlet valve or the quantity control valve 22. This can occur, for example, if the piston 40 in the delivery space 38 carries out a working movement (upward in the drawing), wherein fuel can be delivered into the high-pressure line 26 via a non-return valve 66 which is opened in the process.

The opening or the closing of the quantity control valve 22 takes place as a function of a plurality of variables: firstly as a function of the forces applied via the armature spring 50 and the valve spring 64. Secondly, as a function of the fuel pressure prevailing in the low-pressure line 18 and the delivery space 38. Thirdly as a function of the force of the armature 46, which is determined essentially by a current I flowing through the coil 44 at a particular time.

Figure 3:
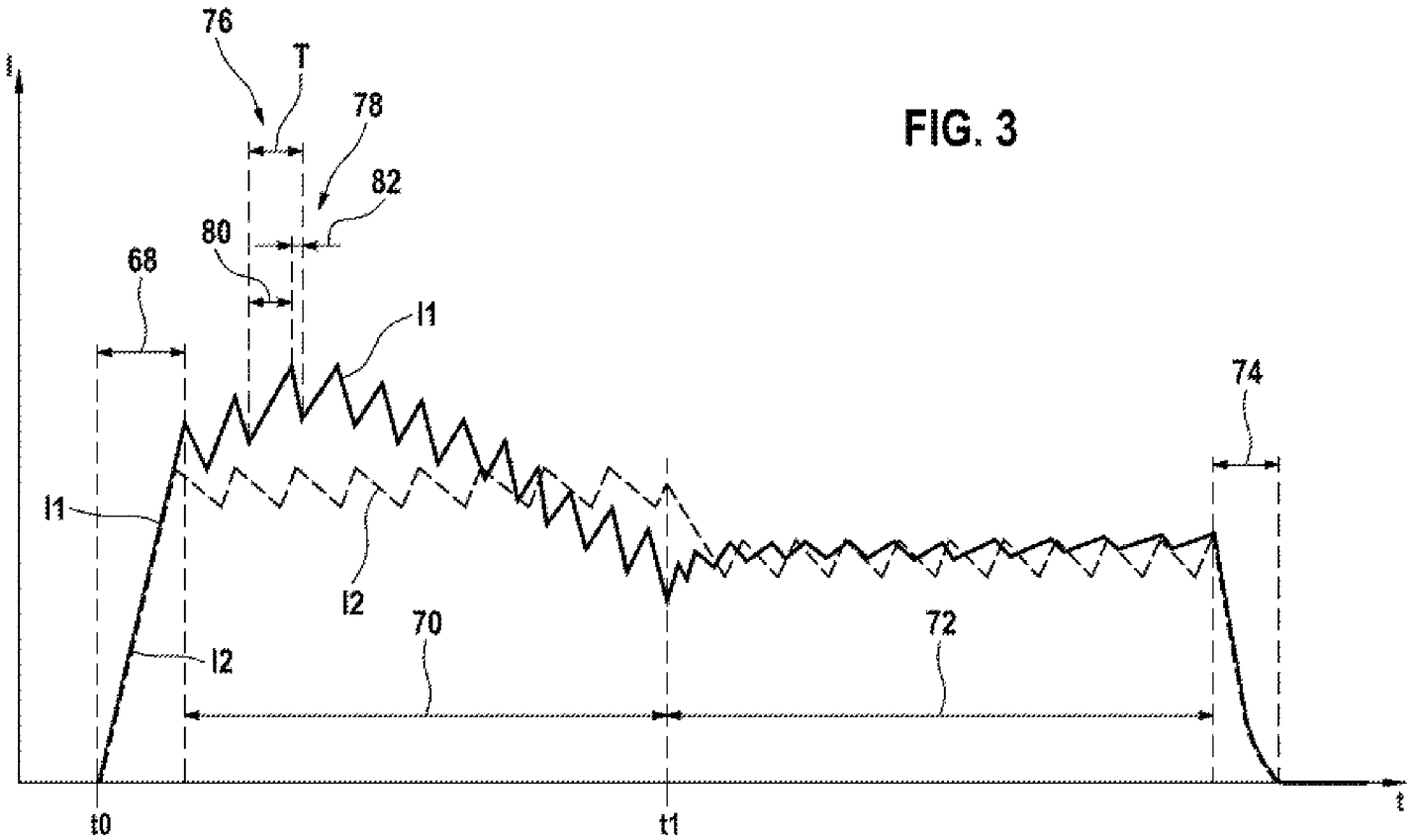
FIG. 3 shows a time diagram of actuation of the electromagnetic activation device.

FIG. 3 shows a timing diagram of an actuation of the quantity control valve 22. In the coordinate system illustrated in the drawing, currents I1 (continuous line) and I2 (dashed lines), which flow across the coil of the electromagnetic activation device 20, are plotted against the time t. Double arrows 68, 70 and 72 characterize a first phase or a second phase or a third phase of the actuation of the electromagnetic activation device 20 and therefore of the coil 44. The first and second phases which start at the time t0 together bring about an attraction phase of the armature 46, and the third phase which starts at the time t1 brings about a holding phase of the armature 46. During the attraction phase, the armature 46 is moved by magnetic force from the rest seat 52 as far as the stroke stop 54. During the holding phase, the armature 46 is held in its position against the stroke stop 54 by a, generally lower, magnetic force.

A time period 74 denotes a further phase of the actuation of the electromagnetic activation device 20 in which the energization of the coil 44 is switched off. Here, the current I1 or I2 is reduced to zero comparatively quickly, with the result that the armature 46 can drop from the stroke stop 54 and back to the rest seat 52.

The profile of the current Il which occurs during the method according to the disclosure is described below. The current I2 occurs during a method according to the prior art in the case of an electromagnetic activation device 20 which is "current-controlled" by means of threshold values, and said current I2 is illustrated only for the sake of comparison.

In the first phase of the actuation, the coil 44 is continuously connected to a voltage, for example a battery voltage of a motor vehicle. The steep rise in the current I1 which is illustrated in the left-hand region of the drawing in FIG. 3 occurs as a result of this.

In the second phase, the voltage is connected periodically to the coil 44 with a (constant) first frequency 76 and with a (constant) first pulse duty factor 78. The first frequency 76 is the reciprocal value of the period duration T (illustrated in the drawing in FIG. 3) of the current I1. The first pulse duty factor 78 is characterized via a relative switch-on duration 80, in which the current I1 rises, and via a relative switch-off duration 82, in which the current I1 drops.

In the third phase, the voltage is connected periodically to the coil 44 with a second frequency (without a reference symbol) and with a second pulse duty factor (without a reference symbol). The second frequency and the second pulse duty factor are also constant during the third phase. Here, the second frequency is dimensioned so as to be equal to the first frequency. The second pulse duty factor has a relative switch-on duration 80 which is shorter than the first pulse duty factor, with the result that a correspondingly lower mean value of the current I1 occurs during the third phase.

The respective duration of the three phases illustrated in FIG. 3 and the first and second frequencies as well as the first and second pulse duty factors are determined using the characteristic diagram 34. This determination occurs before the start (time t0) of the actuation as a function of the current level of the voltage, of the current temperature of the coil 44, of the line resistance of a cable by means of which the coil 44 is connected to the actuation circuit 31, and as a function of the current rotational speed of the internal combustion engine. The profile of the current I1 after the time t0 is thus the result of a control operation, at least for an individual switching process of the quantity control valve 22. A regulation process by means of threshold values which influence the current I1 does not take place.

The profile of the current I2, which is denoted by dashed lines in the drawing in FIG. 3 and which corresponds, as mentioned above, to current-controlled actuation of the coil 44, is approached satisfactorily by the profile of the current I1. In particular, the total energy quantities of the actuation during the first and second phases are substantially the same. The same applies to the third phase.

The total energy quantity for the first and second phases can be determined for the current I1 or the current I2 by means of the following proportional relationships:

$$W_{I1} \sim \int_{t0}^{t1} I1(t)dt \text{ or } W_{I2} \sim \int_{t0}^{t1} I2(t)dt$$

Equality between the two energy levels is to be aimed at here. That is to say $$W_{I1}=W_{I2}.$$

In a further embodiment (not illustrated) the second frequency is dimensioned differently from the first frequency 76.

Figure 4:
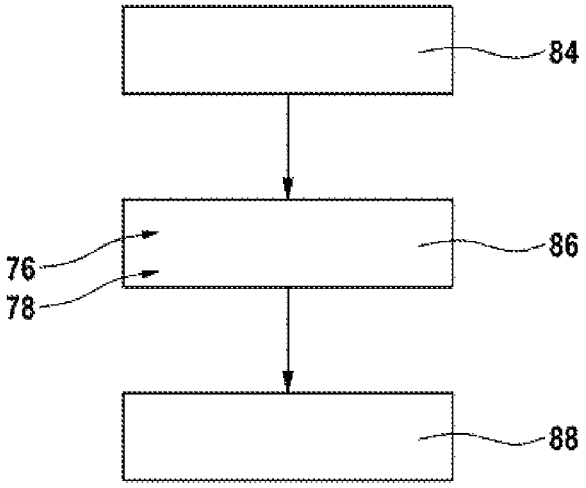
FIG. 4 shows a simplified block diagram for supplementary illustration of the method.

FIG. 4 shows a simplified flow chart of the actuation of the electromagnetic activation device 20. The illustrated method is preferably carried out by means of the computer program 32 in the open-loop and/or closed-loop control device 30 of the internal combustion engine. In a first block 84, the illustrated procedure begins, wherein different variables are determined and/or read out from a data memory of the open-loop and/or closed-loop control device 30:

the current rotational speed of the internal combustion engine;

a fuel quantity to be injected or a value equivalent thereto;

the level of battery voltage;

the temperature of the coil 44; and/or the value of the line resistance of the cable to which the coil 44 is connected.

In addition, further variables or operating variables of the quantity control valve 22 and/or of the internal combustion engine can also be used. In a subsequent second block 86, different actuation variables are determined using the characteristic diagram 34 on the basis of the variables specified above. These actuation variables are:

the respective durations of the three phases;

the first and second frequencies; and/or the first and second pulse duty factors.

These actuation variables and the relationship of their values to one another determine substantially the time profile of the current I such as is illustrated, for example, as a current I1 in FIG. 3.

In a subsequent third block 88, the coil 44 of the electromagnetic activation device 20 is actuated using the determined actuation variables. In this context, the actuation variables, determined in block 86, for a plurality of successive actuations of the coil 44 or switching processes of the quantity control valve 22 can be used, or the actuation variables can alternatively be respectively newly determined for each individual switching process of the quantity control valve 22.

The invention claimed is:

1. An actuation circuit for actuating an electromagnetic activation device of a quantity control valve, comprising:

an actuation mechanism configured to perform an actuation of the electromagnetic activation device to move an armature of the electromagnetic activation device from a first position to a second position in at least three phases, including in a first phase, continuously connecting a coil of the electromagnetic activation device to a voltage;

in a second phase, periodically connecting the coil to the voltage with a first frequency and with a first pulse duty factor; and in a third phase, periodically connecting the coil to the voltage with a second frequency and with a second pulse duty factor.

2. An open-loop and/or closed-loop control device of an internal combustion engine, comprising:

a memory configured to store programmed instructions, which the control device executes to operate an electromagnetic activation device of a quantity control valve to switch in order to set a delivery quantity by actuating the electromagnetic activation device to move an armature of the electromagnetic activation device from a first position to a second position in at least three phases, including:

in a first phase, continuously connecting a coil of the electromagnetic activation device to a voltage;

in a second phase, periodically connecting the coil to the voltage with a first frequency and with a first pulse duty factor; and in a third phase, periodically connecting the coil to the voltage with a second frequency and with a second pulse duty factor.

3. A method for operating a fuel delivery device of an internal combustion engine comprising:

switching an electromagnetic activation device of a quantity control valve in order to set a delivery quantity; and actuating the electromagnetic activation device to move an armature of the electromagnetic activation device from a first position to a second position in at least three phases, including:

in a first phase, continuously connecting a coil of the electromagnetic activation device to a voltage;

in a second phase, periodically connecting the coil to the voltage with a first frequency and with a first pulse duty factor; and in a third phase, periodically connecting the coil to the voltage with a second frequency and with a second pulse duty factor.

4. The method as claimed in claim 3, wherein a respective duration of at least one of the three phases, the first frequency, the second frequency, the first pulse duty factor, and the second pulse duty factor is set as a function of at least one of the voltage, a temperature, a line resistance, and a rotational speed of the internal combustion engine.

5. The method as claimed in claim 4, wherein the respective duration of the at least one of the three phases, the first frequency, the second frequency, the first pulse duty factor, and the second pulse duty factor is determined using at least one characteristic diagram.

6. The method as claimed in claim 3, wherein:

the first and second phases bring about an attraction phase of the armature, and the third phase brings about a holding phase of the armature.

7. The method as claimed in claim 1, wherein the first frequency is equal to the second frequency.

* * * * *